US008316682B2

(12) United States Patent
Kobayashi et al.

(10) Patent No.: US 8,316,682 B2
(45) Date of Patent: Nov. 27, 2012

(54) IRONING APPARATUS

(75) Inventors: Takuo Kobayashi, Tochigi (JP); Takeshi Sano, Tochigi (JP); Yasuhiko Kitano, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 753 days.

(21) Appl. No.: 12/387,062

(22) Filed: Apr. 27, 2009

(65) Prior Publication Data

US 2009/0293324 A1 Dec. 3, 2009

(30) Foreign Application Priority Data

May 30, 2008 (JP) ..... 2008-142879

(51) Int. Cl.
*B21D 7/02* (2006.01)

(52) U.S. Cl. ..... 72/214; 72/452.9

(58) Field of Classification Search ..... 72/191, 72/192, 195, 207, 210, 214, 220, 240, 349, 72/221, 452.8, 452.9
See application file for complete search history.

(56) References Cited

U.S. PATENT DOCUMENTS 149,544 A * 4/1874 Tay ..... 470/132
531,042 A * 12/1894 Johnston ..... 72/207
581,820 A * 5/1897 Gross ..... 72/207
2,875,649 A * 3/1959 Bedker ..... 72/189
3,233,444 A * 2/1966 Groves et al. ..... 72/207
3,345,727 A * 10/1967 Komarnitsky ..... 148/580
3,635,065 A * 1/1972 Sendzimir ..... 72/214
5,673,581 A * 10/1997 Segal ..... 72/184
6,823,705 B2 * 11/2004 Fukuda et al. ..... 72/214
7,043,952 B2 * 5/2006 Kraus et al. ..... 72/220
8,028,558 B2 * 10/2011 Segal ..... 72/184

FOREIGN PATENT DOCUMENTS

JP 61-77118 U 5/1986
JP 1-273638 * 11/1989
JP 3786173 3/2006
JP 2006-297461 11/2006

* cited by examiner

*Primary Examiner* — Edward Tolan
(74) *Attorney, Agent, or Firm* — Carrier Blackman & Associates, P.C.; Joseph P. Carrier; William D. Blackman

(57) ABSTRACT

A second press 10 irons a plate-like steel plate W. This second press 10 comprises a base block 22 for supporting the lower surface of the steel plate W, a rod 11 disposed on the upper surface of the steel plate W, an upper die 30 including a guide rail 24, a first cam 25 and a second cam 34 and a lifting mechanism 40 for moving the rod 11 along the surface of the steel plate W. The base block 22 regulates the movement of the rod 11 in a thickness direction of the steel plate W by contacting the upper surface of the rod 11 over the movement range of the ironing member in the surface direction of the steel plate W.

5 Claims, 6 Drawing Sheets

IRONING APPARATUS

BACKGROUND OF THE INVENTION

1. Field of the Invention

The present invention relates to an ironing apparatus. More particularly, the invention relates to an ironing apparatus for ironing a plate-like work.

2. Description of Related Art

There is a demand for changing plate thickness of a part of a panel member making up a vehicle body to achieve weight reduction while assuring a safety performance of an automobile. Therefore, the use of a high tensile steel plate having high strength is considered. However, since the high tensile steel plate is expensive, the cost of materials increases. Further, it is difficult to employ the high tensile steel plate having certain quality, because the costs greatly increase depending on the places, due to regional differences in the supply system.

Thus, the use of a tailored blank has been proposed. This tailored blank is formed by welding a plurality of kinds of plates having different plate thicknesses.

However, if employing this method, an equipment for joining the plates is required and increases the costs. Also, at a junction of materials, the strength is lowered, or the formability is worse, there is a problem that the structure of a forming die is complicated.

Also, the ironing process has been proposed. The ironing process is, by ironing part of a plate material having certain thickness with a tool, to make thinning the ironed part of the plate material.

Japanese Patent Unexamined Publication JP-A-2006-297461 proposes an ironing method using a press machine. In the press machine of the proposed ironing method, a position of an upper die is horizontally shifted from a position of a lower die from a distance D which is smaller than a thickness of a work. The work is placed between the upper and lower dies, the upper and lower dies are vertically moved to approaches each other so as to pinch the work therebetween, and then, the work is ironed so that the thickness of the pinched portion of the work becomes the distance D which is smaller than the initial thickness of work.

According to this method, there is no junction, unlike the tailored blank, and the lowering strength at the junction can be prevented.

However, in this method, when vertically moving the upper and lower dies while pinching the work therebetween, each die is subjected to a reaction force in the horizontal direction. Therefore, it was required to increase the rigidity of the entire press machine, and thus, the apparatus becomes large in size.

SUMMARY OF THE INVENTION

In view of the above, it is an object of the invention to provide an ironing apparatus that performs the ironing with a simple structure.

According to an aspect of the invention, it is provided an ironing apparatus (e.g., a second press 10) for ironing a plate-like work (e.g., a steel plate W) having principal plane, including:

a support member (e.g., a lower portion of a base block 22) which supports a lower surface of the work;

an ironing member (e.g., a rod 11) disposed on an upper surface of the work;

a driving unit (e.g., an upper die 30 including a guide rail 24, a first cam 25 and a second cam 34 and a lifting mechanism 40) which moves the ironing member along the principal plane of the work; and a regulation member (e.g., an upper portion of the base block 22) which contacts an upper surface of the ironing member over a movement range of the ironing member so as to regulate a movement of the ironing member in a work plate thickness direction.

According to the invention, the work is ironed by moving the ironing member along the principal plane of the work by the driving unit while pressing the work so as to regulate the movement of the ironing member in a work plate thickness direction by the regulation member. In this manner, since reaction force in the work plate thickness direction is received by the regulation member, the entire rigidity of the apparatus can be lower than conventionally, whereby the ironing can be performed with a simple structure.

Further, the steel plate is uniformly ironed to be thinner, with higher strength due to work hardening, thereby achieving the weight reduction of the vehicle body by forming the components of the vehicle body from this steel plate.

Also, the steel plate is ironed to form the parts having different plate thicknesses, and using this steel plate, a plurality of components of the vehicle body can be integrated into one component, or the weight reduction of components can be achieved.

Also, a column-like component having an open section is molded into the component shape and ironed, with higher strength due to work hardening, thereby achieving the weight reduction of the vehicle body.

In this case, it is preferable that the regulation member contacts the upper surface of the ironing member with a contact surface (e.g., a contact surface 223), and the distance between the contact surface and the support member is varied depending on the position of the ironing member in a moving direction.

Conventionally, as another ironing method, Japanese Patent Examined Publication JP-B-3786173 describes a method for rolling the work held between a pair of rolls has been proposed. However, according to this method, only one part of the work can be ironed at once.

However, according to this invention, since the distance of the contact surface of the regulation member from the support member is varied depending on the position of the ironing member in the moving direction, plural positions on the surface of the work can be ironed at once.

According to the invention, the work is ironed by moving the ironing member along the principal plane of the work by the driving unit while pressing the work by regulating the movement of the ironing member in a work plate thickness direction with the regulation member.

In this manner, since a reaction force in the work plate thickness direction is received by the regulation member, the overall rigidity of the apparatus can be lower than conventionally, whereby the ironing can be performed with a simple structure.

Further, the steel plate is uniformly ironed to be thinner, with higher strength due to work hardening, to form the components of the vehicle body from this steel plate, thereby achieving the weight reduction of the vehicle body. Also, the steel plate is ironed to form the parts having different plate thickness, and using this steel plate, a plurality of components of the vehicle body can be integrated into one component, or the weight reduction of components can be achieved.

Also, a column-like component having an open section is molded into the component shape and then ironed, because the strength becomes high due to the work hardening, the weight reduction of the vehicle body can be achieved.

DETAILED DESCRIPTION OF EXEMPLARY EMBODIMENTS OF THE PRESENT INVENTION

An embodiment of the present invention will be described below with reference to the drawings.

Figure 1:
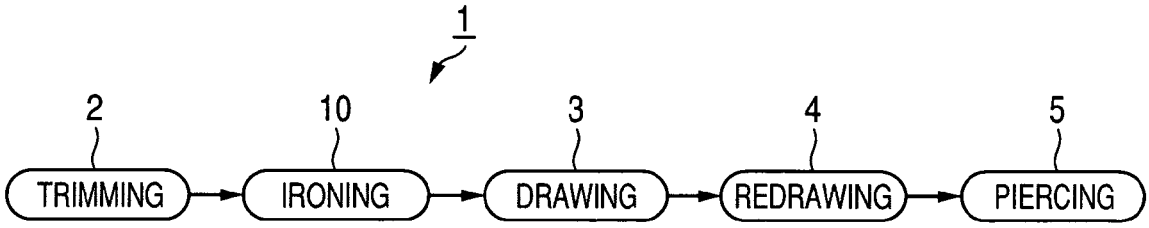
FIG. 1 is a view showing the schematic constitution of a press line with an ironing apparatus according to one embodiment of the invention.

FIG. 1 is a view showing the schematic constitution of a press line 1 with an ironing apparatus according to one embodiment of the invention.

A press line 1 includes a first press 2 for performing trimming process, a second press 10 as an ironing apparatus for performing ironing process, a third press 3 for performing drawing process, a fourth press 4 for performing restriking process, and a fifth press 5 for performing bending and piercing process. This press line 1 performs these processes in order of trimming, ironing, drawing, restriking and bending/piercing.

The first press 2 performs the trimming process for removing unnecessary parts by shearing a work (e.g., steel plate) having principal plane.

The second press 10 performs the ironing process for making at least part of the work thinner.

The third press 3 performs the drawing process for drawing the work.

The fourth press 4 performs the restriking process for drawing the work again.

The fifth press 5 performs the bending process for bending the work and the piercing process for opening a hole in the work.

Figure 2B:
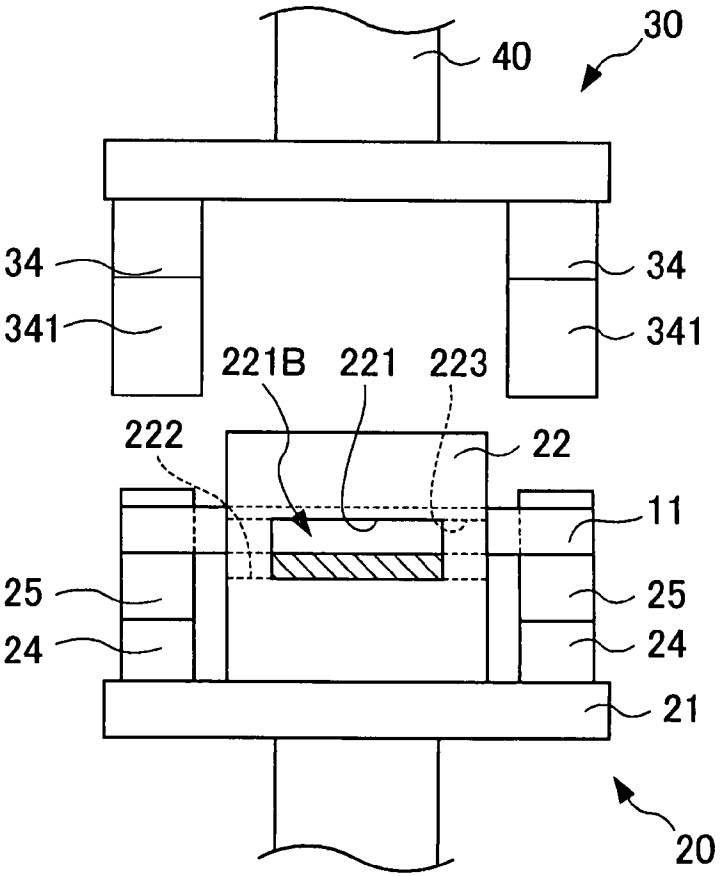
FIG. 2B is a front view of the ironing apparatus according to the embodiment.
Figure 2A:
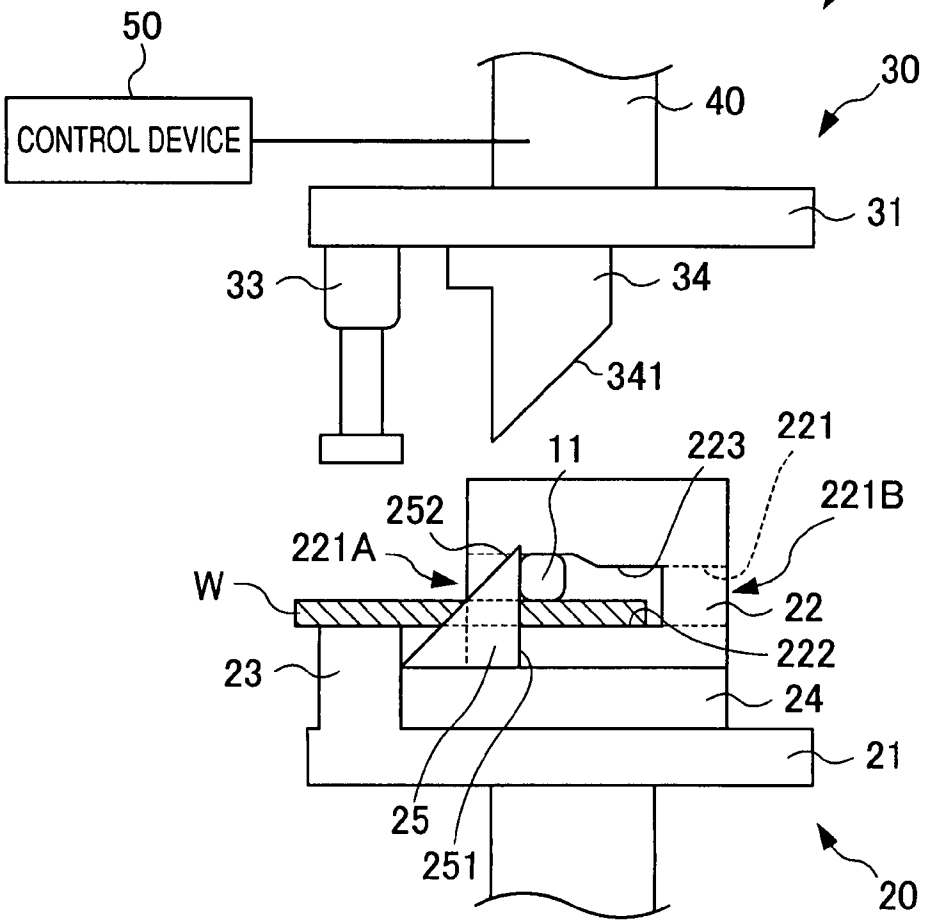
FIG. 2A is a side view of the ironing apparatus according to the embodiment.
Figure 3:
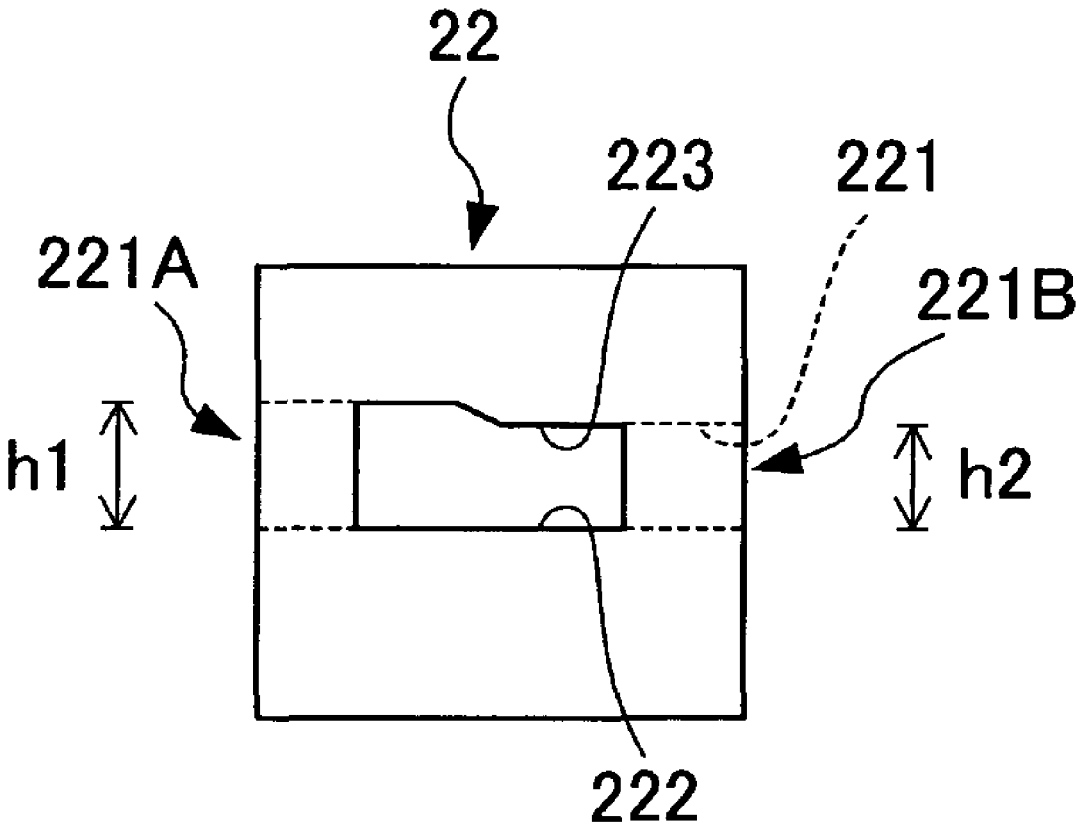
FIG. 3 is an enlarged side view of a part of the ironing apparatus according to the embodiment.

FIGS. 2A and 2B are side and front views of the second press 10. FIG. 3 is an enlarged side view of a base block 22 in the second press 10.

The second press 10 has a lower structure or die 20, an upper structure or die 30 as a part of a driving unit placed above the lower die 20, a lifting mechanism 40 as part of the driving unit for approaching or separating the upper die 30 to/from the lower die 20, and a control device 50 for controlling them.

The lower die 20 includes:

a base portion 21;

a base block 22 which is provided on the base portion 21 and receives the steel plate W, as a support member;

a holder 23 which is provided on the base portion 21 and holds the steel plate W;

a rod 11 as a rod-like ironing member passing through the base block 22 to be laid on the upper surface of the steel plate W;

a pair of guide rails 24 provided on both sides of the base block 22, as part of the driving unit and a pair of first cams 25 provided on a pair of guide rails 24, as part of the driving unit.

The first cam 25 has a contact surface 251 contacting the side surface of the rod 11, and a first inclined surface 252 inclined relative to a moving direction of the upper die 30.

The base block 22 is a rectangular parallelepiped. This base block 22 is formed with a first through hole 221 penetrating from one of two side surfaces mutually opposed to the other. One opening of this first through hole 221 is an opening 221A, and the other opening is an opening 221B.

The steel plate W is put into an interior of the first through hole 221 from the opening 221A. Thereby, a lower surface of the steel plate W is supported on the bottom surface of the first through hole 221.

The guide rail 24 extends in a penetrating direction of the first through holes 221 in the base block 22.

Also, this base block 22 is formed with a second through hole 222 penetrating from one of remaining two side surfaces to the other. That is, this second through hole 222 extends in the direction crossing the first through hole 221.

Herein, a bottom surface of the first through hole 221 and a bottom surface of the second through hole 222 are on the same plane, and a ceiling surface of the first through hole 221 and a ceiling surface of the second through hole 222 are also on the same plane. Hence, the height dimension of the first through hole 221 and the height size of the second through hole 222 are equal.

The rod 11 is inserted into the second through hole 222, and both ends of the rod 11 are protruded to outside of the base block 22.

This rod 11 is movable within the second through hole 222 along the penetrating direction of the first through hole 221. In other words, a movable range of the rod 11 is within the second through hole 222.

Further, the ceiling surface of the second through hole 222 is a contact surface 223 for regulating the movement of the rod 11 in the plate thickness direction of the steel plate W by contacting the upper surface of the rod 11. That is, this contact surface 223 is formed over the moving range of the rod 11.

The height of the contact surface 223 from the bottom surface of the first through hole 221 varies depending on the position of the rod 11 in the penetrating direction of the first through hole 221, as shown in FIG. 3. More specifically, the height of the contact surface 223 is $h_1$ on the side of the opening 221A in the second through hole 222, but is lower toward the side of the opening 221B, and $h_2$ below $h_1$ on the side of the opening 221B.

The upper die 30 includes a base portion 31, a holder 33 provided on the base portion 31, and a pair of second cams 34.

The holder 33 is disposed at a position opposite to a holder 23 of the lower die 20 while holding the steel plate W therebetween, and can move toward or back relative to the holder 23.

The second cam 34 has a second inclined surface 341 contacting the first inclined surface 252 of the first cam 25.

A control device 50 controls the lifting mechanism 40 to perform the ironing of the steel plate W.

First, the steel plate W is put into the interior of the first through hole 221 from the opening 221A.

Then, the steel plate W is accommodated within interior of the base block 22, and the base end side of the steel plate W is laid on the holder 23, as shown in FIGS. 2A and 2B. In this state, the rod 11 is located on the side of the opening 221A in the through hole 222, and the contact surface 223 does not press the rod 11, because the height of the contact surface 223 is $h_1$.

Figure 4B:
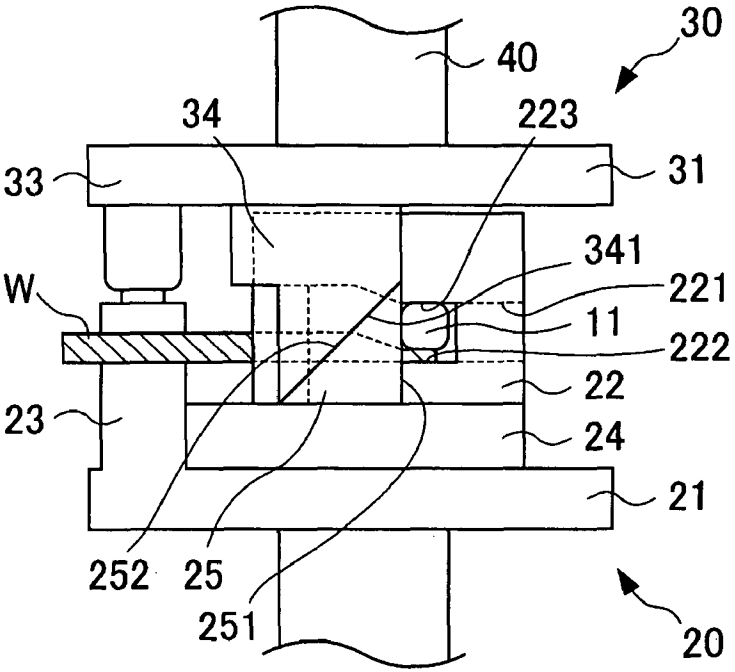
FIGS. 4A and 4B are views for explaining the operation of the ironing apparatus according to the embodiment.
Figure 4A:
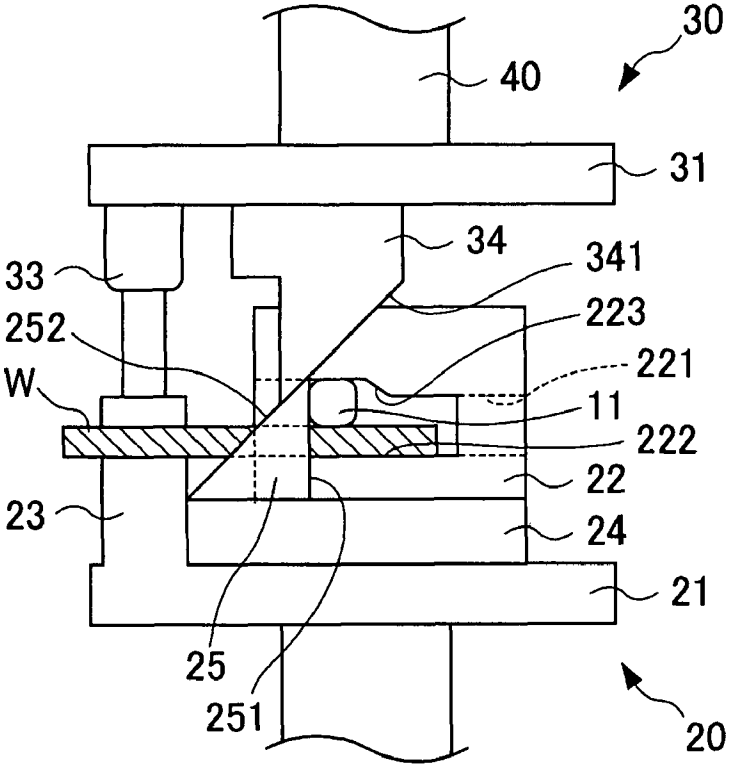

Then, the upper die 30 is lowered by the lifting mechanism 40 from the state as shown in FIGS. 2A and 2B, to hold the base end side of the steel plate W between the holder 23 and the holder 33, and bring a part of the first inclined surface 252 of the first cam 25 into contact with the second inclined surface 341 of the second cam 34, as shown in FIG. 4A.

Then, the upper die 30 is further lowered to move the second cam 34 downward and compress the holder 33 (a gas spring, etc.), as shown in FIG. 4B. More specifically, the holder 33 is controlled so that the steel plate W can be securely held with an adequate force by the holder 23 and the holder 33. Then, the first inclined surface 252 of the first cam 25 is pressed by the second inclined surface 341 of the second cam 34, so that the first cam 25 moves along the guide rails 24, while pressing the rod 11 with the contact surface 251. Thereby, within the inside of the second through hole 222, the rod 11 is moved in the penetrating direction of the first through hole 221 along the principal plane of the steel plate W. Then, since the height of the contact surface 223 in the base block 22 changes from $h_1$ to $h_2$, the rod 11 is pressed by the contact surface 223, that is, the movement of the rod 11 in the plate thickness direction of the steel plate W is regulated, so that the top side of the steel plate W is ironed.

Thereafter, the steel plate W is taken out through the opening 221A.

Figure 5:
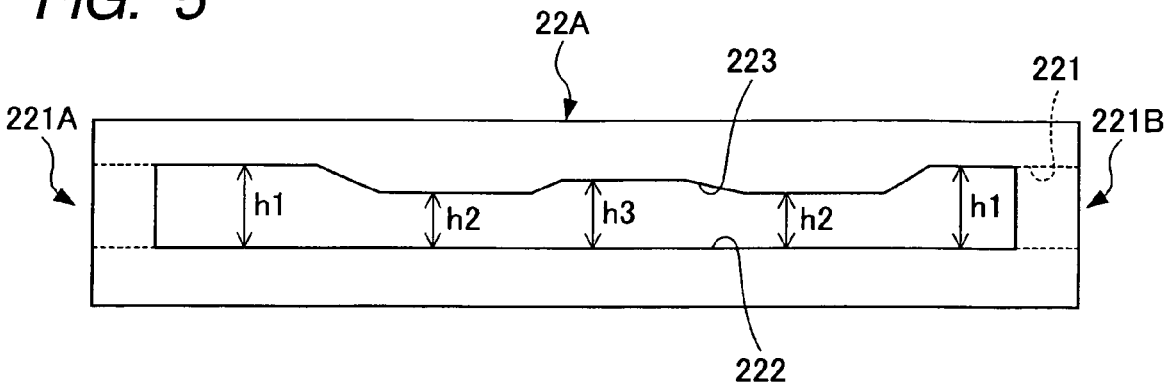
FIG. 5 is a view showing a variation example of the ironing apparatus according to the embodiment.

Although the height of the contact surface 223 is $h_1$ on the side of the opening 221A in the second through hole 222 and $h_2$ on the side of the opening 221B in this embodiment, it will be appreciated that the height of the contact surface 223 or the length in the penetrating direction of the first through hole 221 may be appropriately set up. For example, in the base block 22A, the height of the contact surface 223 may be changed in order of $h_1$, $h_2$ lower than $h_1$, $h_3$ higher than $h_2$ but lower than $h_1$, $h_2$ and $h_1$ from the opening 221A to the opening 221B, as shown in FIG. 5. In this way, it is possible to perform the ironing on plural positions on the surface of the steel plate W at once.

Using the above press 10, the plate thickness of any part of the work can be changed by performing the ironing twice in the different ironing directions, as shown in FIG. 6.

Figure 6A:
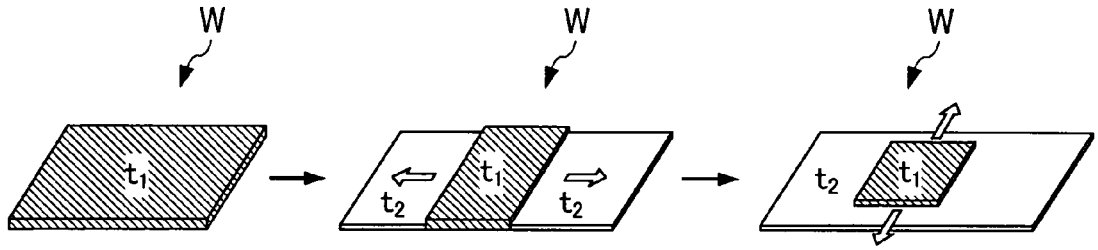
FIGS. 6A and 6B are views for explaining a procedure for changing the plate thickness of any portion of the work using the ironing apparatus according to the embodiment.

That is, the plate-like work W having plate thickness $t_1$ is ironed at both end portions into the plate thickness $t_2$ at both end portions, and thereafter, the work W is ironed at both end portions again by changing the ironing direction by 90 degrees to have the plate thickness $t_2$ at both end portions, as shown in FIG. 6A. Thereby, the plate thickness of the work W on a peripheral portion can be made $t_2$.

Figure 6B:
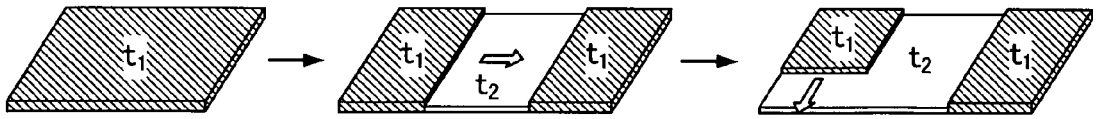

Also, the plate-like work W having plate thickness $t_1$ is ironed at a central portion in the length direction into the plate thickness $t_2$ at the central portion, as shown in FIG. 6B. Thereby, the work W has two remaining portions having plate thickness $t_1$ in a non-worked state. Thereafter, one of the two remaining portions is ironed by changing the ironing direction by 90 degrees, whereby the plate thickness of a part of this remaining portion is made $t_2$. Thereby, the plate thickness of the work W can be made $t_2$ at the central portion in the length direction and the peripheral portion.

Also, using the press 10, the ironing is performed twice by changing the ironing direction, whereby the plate thickness of any portion of the work can be changed into any different thickness, as shown in FIG. 7.

Figure 7A:
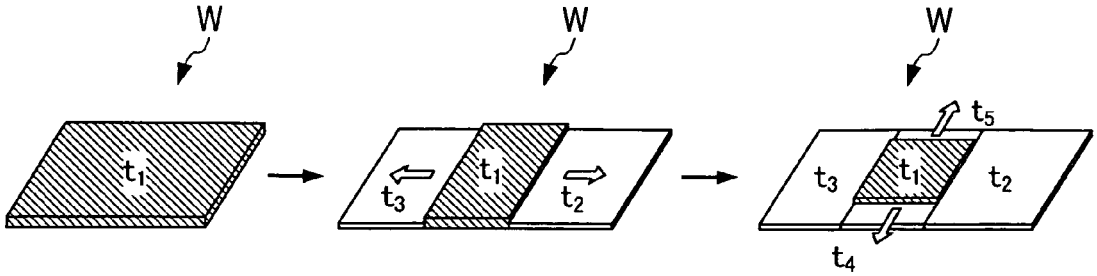
FIGS. 7A and 7B are views for explaining a procedure for changing the plate thickness of any portion of the work using the ironing apparatus according to the embodiment.

That is, the plate-like work W having plate thickness $t_1$, is ironed at both end portions, whereby the plate thickness of one end portion is made $t_2$ and the plate thickness of the other end portion is made $t_3$, as shown in FIG. 7A. Thereafter, the work W having plate thickness $t_1$ is ironed at the central portion by changing the ironing direction by 90 degrees, whereby the plate thickness of one part is made $t_4$ and the plate thickness of the other is made $t_5$. Thereby, the parts having plate thicknesses $t_2$ to $t_5$ can be formed in the peripheral portion of the work W.

Figure 7B:
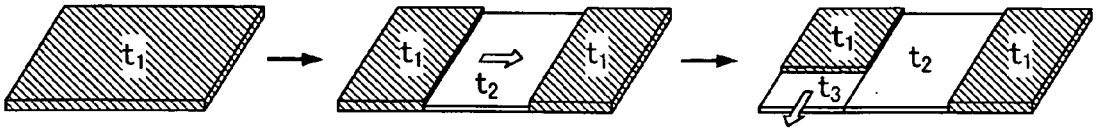

Also, the plate-like work W having plate thickness $t_1$ is ironed at the central portion in the length direction into the plate thickness $t_2$ at the central portion, as shown in FIG. 7B. Thereby, the work W has two remaining portions having plate thickness $t_1$ in the non-worked state. Thereafter, one of two remaining portions is ironed by changing the ironing direction by 90 degrees, whereby the plate thickness of a part of this remaining portion is made $t_3$. Thereby, the plate thickness of the work W is made $t_2$ at the central portion in the length direction and the plate thickness of a part of the peripheral portion can be made $t_3$.

This embodiment has the following effects.

(1) The ironing process for the steel plate W is performed by pressing the steel plate W against the base block 22 that regulates the movement of the rod 11 in the plate thickness direction of the steel plate W, and driving the lifting mechanism 40 to move the rod 11 along the principal plane of the steel plate W. In this way, since a reaction force of the steel plate W in the plate thickness direction is received by the base block 22, the overall rigidity of the apparatus can be made lower than conventionally, whereby the ironing can be performed with a simple structure.

(2) Since the height of the contact surface 223 for the base block 22 is varied depending on the position of the rod 11 in the moving direction, it is possible to perform the ironing for plural positions on the surface of the steel plate W at once.

(3) The ironing process for the steel plate W is performed uniformly to make the steel plate thinner, and give higher strength by work hardening, and the components of the vehicle body are formed from this steel plate W, whereby the weight reduction of the vehicle body can be realized.

(4) The ironing for the steel plate W is performed to form the parts having different plate thicknesses, as shown in FIGS. 6 and 7, and a plurality of components of the vehicle body are integrated into one component, using this steel plate W, and the weight reduction of components can be realized.

Figure 8:
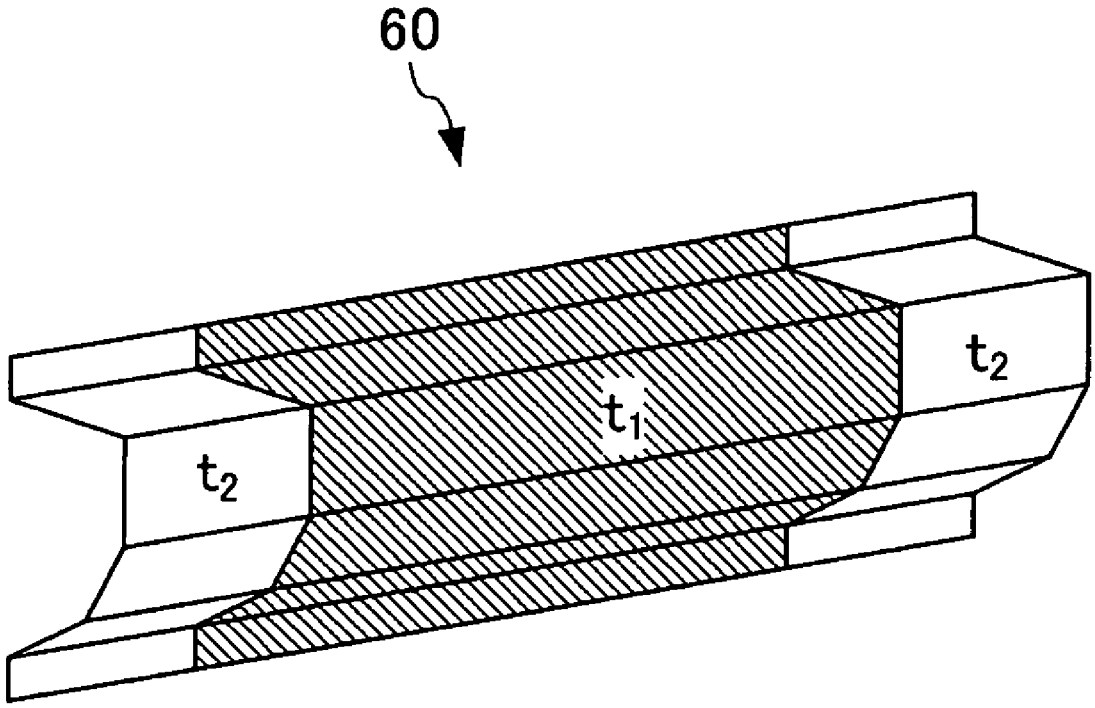
FIG. 8 is a perspective view of a side sill component ironed by the ironing apparatus according to the embodiment.

(5) For a column-shape component having an open section such as a side sill component 60 of hut shape in cross section, by performing the ironing process for both ends of the component, after molding the steel plate having plate thickness $t_1$ into the shape of component, and forming a portion having plate thickness $t_2$ with higher strength by work hardening, the weight reduction of the vehicle body can be realized, as shown in FIG. 8.

While the invention has been described in connection with the exemplary embodiments, it will be obvious to those skilled in the art that various changes and modifications may be made therein without departing from the present invention, and it is aimed, therefore, to cover in the appended claim all such changes and modifications as fall within the true spirit and scope of the present invention.

What is claimed is:

1. An ironing apparatus for ironing a plate-like work, comprising:

a lower structure; and an upper structure which moves towards and away from the lower structure;

wherein the lower structure comprises:

a support member which supports a lower surface of the work;

an ironing member disposed on an upper surface of the work;

a first cam; and a regulation member joined to the support member such that a fixed spacing is provided between the support member and the regulation member;

wherein the upper structure comprises a second cam which moves toward the first cam and presses the first cam such that the first cam moves the ironing member along the upper surface of the work during an ironing operation, and wherein the regulation member contacts an upper surface of the ironing member over a movement range of the ironing member so as to regulate a movement of the ironing member in a work plate thickness direction.

2. The ironing apparatus according to claim 1, wherein the regulation member has a contact surface contacting with the upper surface of the ironing member, and a distance between the contact surface and the support member is varied depending on a position of the ironing member in a moving direction.

3. The ironing apparatus according to claim 1, wherein the first cam moves the ironing member in a non-rolling manner.

4. The ironing apparatus according to claim 1, wherein the support member and the regulation member are joined together to form a base block, the base block comprising:

a first through hole into which the work in inserted; and a second through hole into which the ironing member is inserted;

wherein the first through hole and the second through hole are defined between opposing surfaces of the support member and the regulation member, and the second through hole penetrates the base block in a direction crossing the first through hole.

5. The ironing apparatus according to claim 1, wherein the support member and the lower structure comprises a lower holder, the upper structure comprises an upper holder, and the lower holder and the upper holder hold the work therebetween before the ironing operation and maintain the work in a given position during the ironing operation.

* * * * *